US012709511B2

(12) United States Patent
Akamatsu

(10) Patent No.: US 12,709,511 B2
(45) Date of Patent: Aug. 18, 2026

(54) SHEET STACKING APPARATUS AND IMAGE FORMING APPARATUS

(71) Applicant: CANON KABUSHIKI KAISHA, Tokyo (JP)

(72) Inventor: Yuki Akamatsu, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 295 days.

(21) Appl. No.: 18/664,563

(22) Filed: May 15, 2024

(65) Prior Publication Data

US 2024/0400340 A1 Dec. 5, 2024

(30) Foreign Application Priority Data

Jun. 2, 2023 (JP) ..... 2023-091931

(51) Int. Cl.

| | |
|---|---|
| ***B65H 31/02*** | (2006.01) |
| ***B65H 29/12*** | (2006.01) |
| ***B65H 29/14*** | (2006.01) |
| ***B65H 43/00*** | (2006.01) |

(52) U.S. Cl.

CPC ..... *B65H 43/00* (2013.01); *B65H 29/125* (2013.01); *B65H 29/14* (2013.01); *B65H 31/02* (2013.01); *B65H 2511/10* (2013.01); *B65H 2515/12* (2013.01)

(58) Field of Classification Search

CPC ..... B65H 31/02; B65H 29/14; B65H 29/125
USPC ..... 270/58.12, 58.17, 58.27
See application file for complete search history.

(56) References Cited

U.S. PATENT DOCUMENTS

| | | | | |
|---|---|---|---|---|
| 5,671,920 | A * | 9/1997 | Acquaviva | B65H 29/32 271/197 |
| 5,762,328 | A * | 6/1998 | Yamada | B65H 31/34 270/58.11 |
| 6,264,194 | B1 * | 7/2001 | Hayashi | B65H 31/3027 271/220 |
| 7,419,150 | B2 * | 9/2008 | Kushida | B65H 31/26 270/58.11 |
| 7,641,195 | B2 | 1/2010 | Suzuki | |
| 8,152,162 | B2 | 4/2012 | Obuchi | |
| 10,315,880 | B2 * | 6/2019 | Nakano | B65H 29/145 |

FOREIGN PATENT DOCUMENTS

| | | |
|---|---|---|
| JP | 2008063094 A | 3/2008 |
| JP | 2010168218 A | 8/2010 |
| JP | 2021046297 A | 3/2021 |

* cited by examiner

*Primary Examiner* — Leslie A Nicholson, III
(74) *Attorney, Agent, or Firm* — ROSSI, KIMMS & McDOWELL LLP

(57) ABSTRACT

A sheet stacking apparatus includes a stacking portion, a conveyance portion configured to convey the sheet toward the stacking portion, an abutting portion against which a leading edge of the sheet in the sheet conveyance direction is abutted, a first conveyance member, a second conveyance member movable to a contact position at which the second conveyance member contacts the sheet stacked on the stacking portion and to a retracted position to which the second conveyance member is retracted from the sheet stacked on the stacking portion, and a control portion configured to execute a first mode in which the second conveyance member is positioned at the contact position and a second mode in which the second conveyance member is positioned at the retracted position.

16 Claims, 9 Drawing Sheets

FIG.7

| | SHEET SIZE | | GRAMMAGE GROUP [gsm] | | | | | |
|---|---|---|---|---|---|---|---|---|
| | SHORT SIDE [mm] | LONG SIDE [mm] | 45-100 | 100-200 | 200-250 | 250-300 | 300-350 | 350-400 |
| B5 | 257 | 182 | No | No | No | No | No | No |
| EXEC | 267 | 184 | No | No | No | No | No | No |
| LTR | 279.4 | 215.9 | No | No | No | No | No | No |
| A4 | 297 | 210 | No | No | No | No | No | No |
| LGL | 215.9 | 355.6 | No | No | No | No | No | No |
| B4 | 364 | 257 | No | No | No | No | No | No |
| 8K | 267 | 390 | No | No | No | No | No | No |
| 11×17 | 279.4 | 431.8 | No | No | No | No | No | Yes |
| A3 | 297 | 420 | No | No | No | No | No | Yes |
| 12×18 | 304.8 | 457.2 | No | No | No | Yes | Yes | Yes |
| SRA3 | 320 | 450 | No | No | Yes | Yes | Yes | Yes |
| 13×19.2 | 330.2 | 487.7 | No | Yes | Yes | Yes | Yes | Yes |
| B3 | 364 | 515 | No | Yes | Yes | Yes | Yes | Yes |

SHEET STACKING APPARATUS AND IMAGE FORMING APPARATUS

BACKGROUND OF THE INVENTION

Field of the Invention

The present invention relates to a sheet stacking apparatus for stacking sheets, and an image forming apparatus for forming images on sheets.

Description of the Related Art

In an image forming apparatus, a sheet stacking apparatus, such as a large-capacity stacker, is used for stacking sheets on which images are formed. Japanese Patent Application Publication No. 2010-168218 describes a sheet stacking apparatus. The sheet stacking apparatus conveys a sheet while causing a gripper supported by a timing belt, to hold the sheet; and then causes a knurled belt to abut the leading edge of the sheet against a stopper for aligning the sheet.

In recent years, it has been required to achieve a sheet stacking apparatus and an image forming apparatus that can use a variety of sheets that serve as the recording material. However, in the configuration described in Japanese Patent Application Publication No. 2010-168218, even if the conveyance force that the knurled belt applies to the sheet is adjusted, the failure in alignment may occur due to insufficient conveyance force, or the deterioration in alignment may occur due to bending or buckling of the sheet caused by excessive conveyance force.

SUMMARY OF THE INVENTION

The present invention provides a sheet stacking apparatus and an image forming apparatus that can achieve good alignment for more various types of sheets.

According to an aspect of the invention, a sheet stacking apparatus includes a stacking portion on which a sheet is stacked, a conveyance portion configured to convey the sheet toward the stacking portion in a sheet conveyance direction, an abutting portion against which a leading edge of the sheet in the sheet conveyance direction is abutted, a first conveyance member configured to contact the sheet stacked on the stacking portion and apply conveyance force to the sheet for moving the leading edge of the sheet toward the abutting portion, a second conveyance member configured to contact the sheet stacked on the stacking portion and apply conveyance force to the sheet for moving the leading edge of the sheet toward the abutting portion, the second conveyance member being movable to a contact position at which the second conveyance member contacts the sheet stacked on the stacking portion and to a retracted position to which the second conveyance member is retracted from the sheet stacked on the stacking portion, and a control portion configured to execute a first mode and a second mode, the first mode being a mode in which the second conveyance member is positioned at the contact position such that the sheet is conveyed by the first conveyance member and the second conveyance member, the second mode being a mode in which the second conveyance member is positioned at the retracted position such that the sheet is conveyed by the first conveyance member.

Further features of the present invention will become apparent from the following description of exemplary embodiments with reference to the attached drawings.

BRIEF DESCRIPTION OF THE DRAWINGS

FIG. 7 is a table in which the sheet information and the need for an assist belt to enter are associated with each other.

DESCRIPTION OF THE EMBODIMENTS

Hereinafter, some embodiments of the present disclosure will be described with reference to the accompanying drawings.

Figure 1:
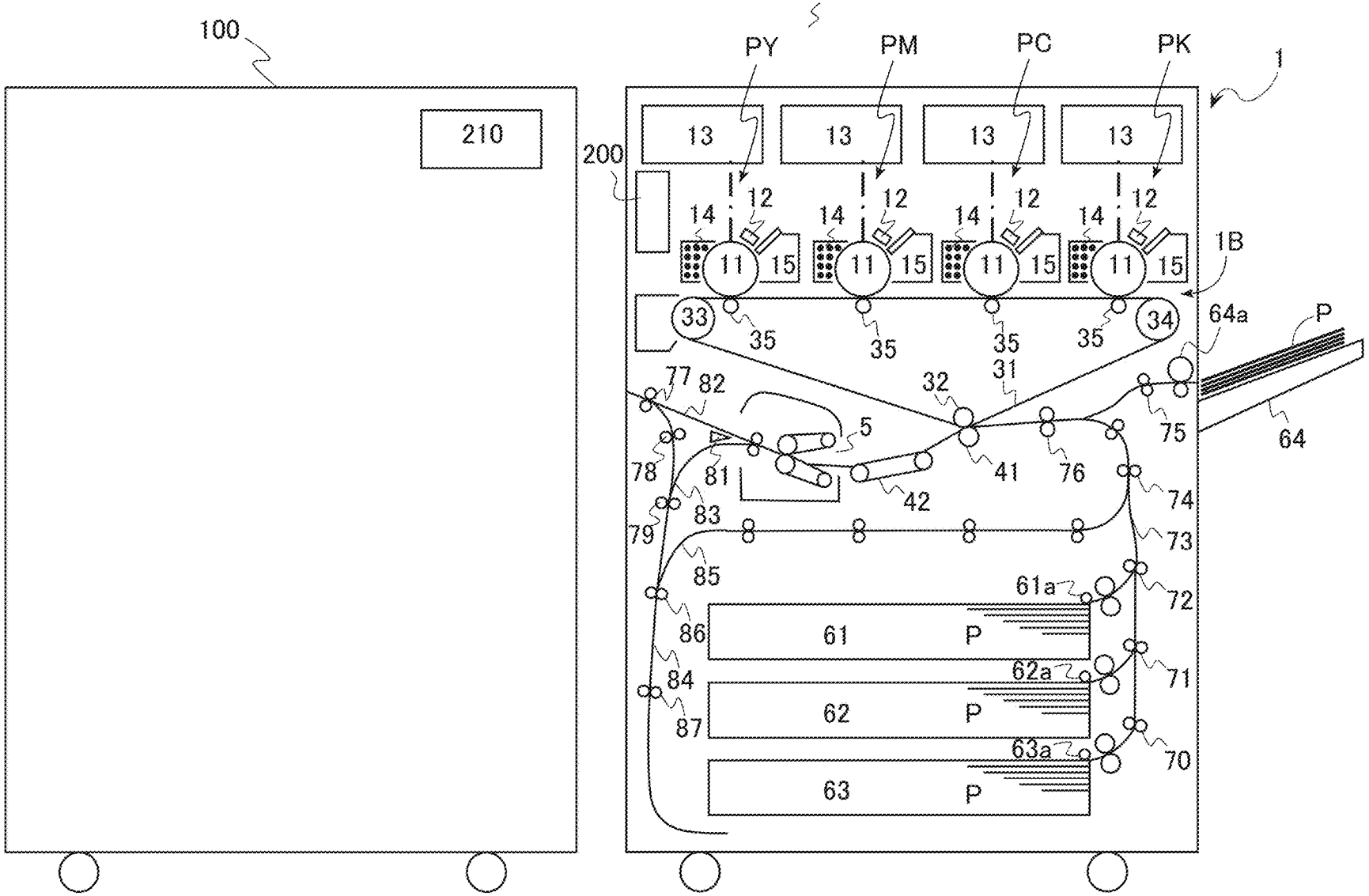
FIG. 1 is a schematic diagram of an image forming apparatus of an embodiment.

FIG. 1 is a schematic diagram illustrating an image forming apparatus 1S that is one embodiment. The image forming apparatus 1S includes an image forming apparatus body (printer portion) 1 and a stacker 100. The image forming apparatus body 1 forms an image on a sheet P. The stacker 100 receives the sheet P, on which an image is formed, from the image forming apparatus body 1; and stacks the sheet P. The sheet P, which is a recording material (recording medium), may be any one of a variety of sheets with different sizes and materials. For example, the sheet P may be a paper sheet, such as a plain paper sheet or a thick paper sheet, a sheet material, such as a coated paper sheet, on which certain surface treatment has been performed, a specially-shaped sheet material, such as an envelope or an index paper sheet, a plastic film, or a cloth sheet.

The image forming apparatus body 1 is a color-image forming apparatus that uses an electrophotographic system. The image forming apparatus body 1 includes an intermediate-transfer tandem image forming portion 1B. In the intermediate-transfer tandem image forming portion 1B, process portions (process units, image forming stations) PY, PM, PC, and PK that form four-color toner images are disposed adjacent to each other, along an intermediate transfer belt 31. The intermediate-transfer tandem system is advantageous in the adaptability to a variety of sheets P, and in the productivity in printing.

The image forming apparatus 1S is an image forming system that includes the image forming apparatus body 1 and the stacker 100 that serves as a sheet stacking apparatus. Note that the image forming apparatus 1S may include another apparatus other than the image forming apparatus body 1 and the stacker 100. Examples of such an apparatus include a sheet feeding apparatus (option feeder) that feeds a sheet P to the image forming apparatus body 1, and a sheet processing apparatus (finisher) that performs a process, such as a binding process, on the sheet P.

Image Forming Apparatus Body

Next, a configuration of the image forming apparatus body 1 will be described. The image forming apparatus body 1 includes the image forming portion 1B, a fixing apparatus 5, cassettes 61 to 63, a manual feed tray 64, a conveyance guide that forms the conveyance path of the sheet P, a various type of roller pairs that conveys the sheet P, and a control portion 200.

The image forming portion 1B includes the four process portions PY, PM, PC, and PK, the intermediate transfer belt 31, and a secondary transfer roller 41. Each process portion (e.g., PY) includes a photosensitive drum 11 that serves as an image bearing member, a charging apparatus 12, an exposure apparatus 13, a developing apparatus 14, a primary transfer apparatus 35, and a cleaning apparatus 15. Each developing apparatus 14 contains toner, as developer, with a color of yellow, magenta, cyan, or black. However, the number of colors of the toner is not limited to four, and the order of the colors is not limited to the above-described order. The intermediate transfer belt 31 is stretched by and wound around a driving roller 33, a tension roller 34, and a secondary transfer inner roller 32; and is rotated by the rotation of the driving roller 33. The secondary transfer roller 41 is in contact with the secondary transfer inner roller 32, via the intermediate transfer belt 31. In addition, a secondary transfer portion is formed, as a nip portion, between the secondary transfer roller 41 and the intermediate transfer belt 31. The secondary transfer portion serves as a transfer portion in which a toner image is transferred to the sheet P.

Next, an outline of the image forming operation will be described. In the image forming operation, monochrome toner images of yellow, magenta, cyan, and black are formed on the photosensitive drums 11 by the process portions PY, PM, PC, and PK, and the monochrome toner images are superposed on each other on the intermediate transfer belt 31, so that a full-color image is formed.

In each of the process portions PY, PM, PC, and PK, the photosensitive drum 11 is driven and rotated, and the surface of the photosensitive drum 11 is uniformly charged by the charging apparatus 12. The exposure apparatus 13 emits light to the photosensitive drum 11 in accordance with a signal that the exposure apparatus 13 receives from the control portion 200, and exposes the photosensitive drum 11 with the light. With this operation, an electrostatic latent image is formed on the surface of the photosensitive drum 11. The developing apparatus 14 supplies the toner to the photosensitive drum 11, and develops the electrostatic latent image into a toner image. The primary transfer apparatus 35 primary-transfers the toner image borne on the photosensitive drum 11, to the intermediate transfer belt 31. The transfer residual toner that was not transferred to the intermediate transfer belt 31 and that is left on the photosensitive drum 11 is collected by the cleaning apparatus 15.

The monochrome toner images formed by the process portions PY, PM, PC, and PK are primary-transferred to the intermediate transfer belt 31 at timings that are adjusted so that the monochrome toner images are superposed on each other on the intermediate transfer belt 31. As a result, a full-color image is formed on the intermediate transfer belt 31. The full-color image is conveyed to the secondary transfer portion by the rotation of the intermediate transfer belt 31.

In parallel with the formation of the toner image by the image forming portion 1B, a conveyance operation for the sheet P is performed. The sheet P is stacked on the cassette 61, 62, or 63, or the manual feed tray 64; and is fed, one by one, by a feeding unit 61*a*, 62*a*, 63*a*, or 64*a*. The sheet P fed in this manner is conveyed through a feeding path 73 by conveyance roller pairs 70, 71, 72, 74, and 75; and reaches a registration roller pair 76. The registration roller pair 76 blocks the leading edge of the sheet P, and corrects the skew of the sheet P. After that, the registration roller pair 76 conveys the sheet P to the secondary transfer portion in synchronization with a timing at which the full-color image reaches the secondary transfer portion. In the secondary transfer portion, the full-color image is secondary-transferred from the intermediate transfer belt 31 to the sheet P by the secondary transfer roller 41.

After that, the sheet P is conveyed to the fixing apparatus 5 by a pre-fixing conveyance unit 42. The pre-fixing conveyance unit 42 conveys the sheet P by rotating a belt while causing the belt to suck the sheet P by generating the negative pressure by using a fan or the like. The fixing apparatus 5 is a heat-fixing unit that includes a rotary member pair and a heating portion. The rotary member pair includes a roller or a belt, and the heating portion heats the image formed on the sheet P. The heating portion may be a halogen lamp or an induction heating mechanism. The fixing apparatus 5 fixes the image to the sheet P by heating and pressing the toner image formed on the sheet P, while nipping and conveying the sheet P in the nip portion (fixing nip) of the rotary member pair.

The conveyance path of the sheet P that has passed through the fixing apparatus 5 is switched by a switching guide 81. If the single-side printing (i.e., a single-side image forming operation) is performed, the sheet P is guided to a discharging path 82 by the switching guide 81, and is discharged from the image forming apparatus body 1 by a discharging roller pair 77. If the double-side printing (i.e., a double-side image forming operation) is performed, the sheet P on which an image is formed on a first side is guided to a reversing path 83 by the switching guide 81, and is conveyed to a switchback path 84 via a conveyance roller pair 79. The sheet P that has been switch-backed by reversing roller pairs 86 and 87 is conveyed to the registration roller pair 76 again, through a duplex conveyance path 85. The sheet P passes through the secondary transfer portion and the fixing apparatus 5 again, so that an image is formed on a second side of the sheet P. After that, the sheet P is guided to the discharging path 82 by the switching guide 81, and is discharged from the image forming apparatus body 1 by the discharging roller pair 77.

Note that if the single-side printing is performed, the image forming apparatus body 1 can perform so-called face-down discharging. In the face-down discharging, the sheet P is discharged in a state where a surface of the sheet P on which an image is formed faces down. In this case, the sheet P that has passed through the fixing apparatus 5 is guided to the reversing path 83, then switch-backed in the switchback path 84, and then conveyed to the discharging roller pair 77 via a second discharging path 78.

The intermediate-transfer tandem image forming portion 1B described in the present embodiment is one example of an image forming portion that forms an image on the sheet P. For example, the image forming portion may be a direct-transfer electrophotographic unit that directly transfers a toner image from the image bearing member to a sheet, not via the intermediate transfer member, an ink-jet printing unit; or an offset-printing unit.

Description of Control Portion

Figure 2:
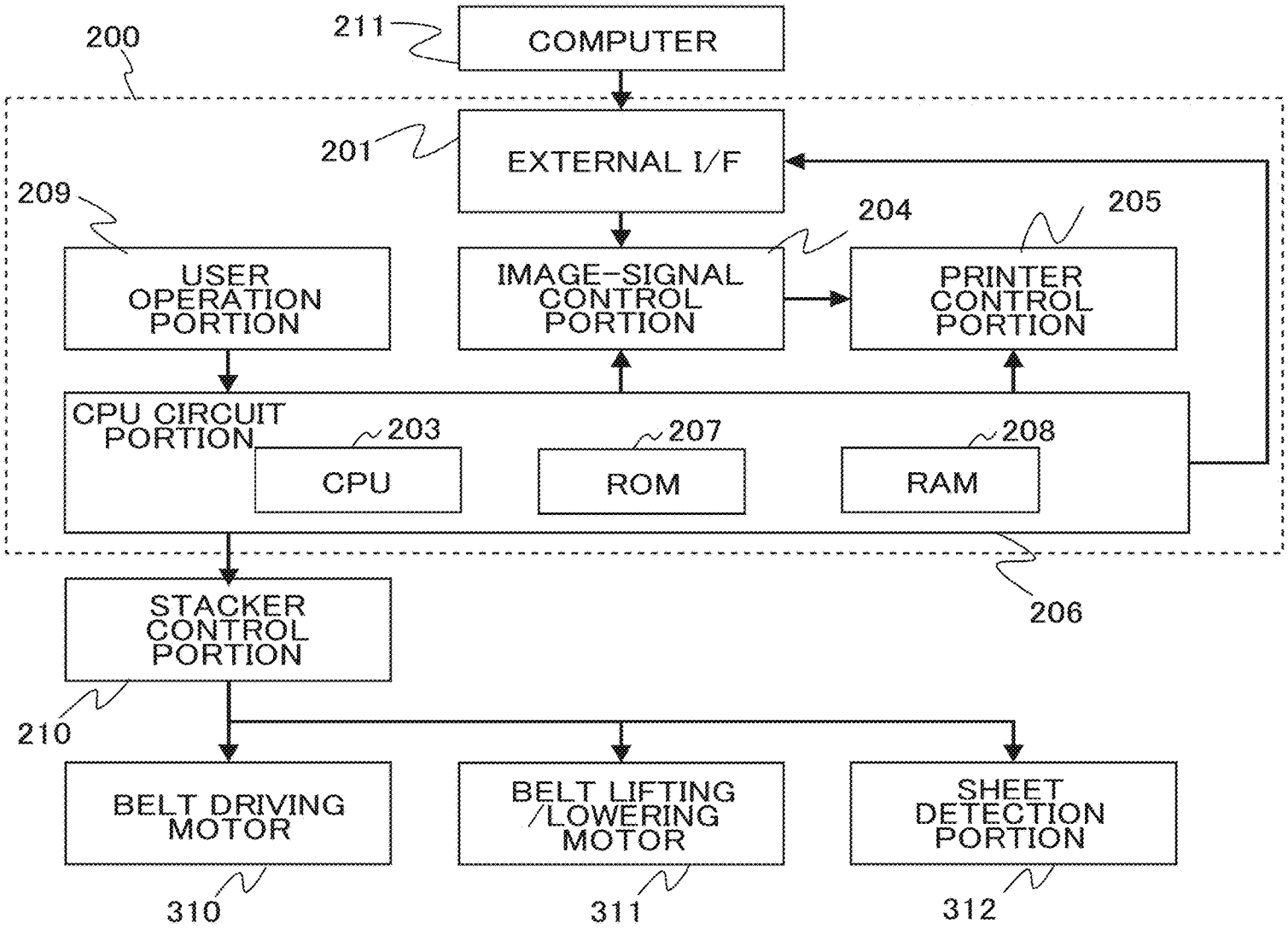
FIG. 2 is a block diagram illustrating a control portion of the image forming apparatus of the embodiment.

FIG. 2 is a block diagram illustrating a configuration of the control portion 200. The control portion 200 includes a CPU circuit portion 206. The CPU circuit portion 206 includes a CPU 203, a ROM 207, and a RAM 208. The CPU circuit portion 206 controls the whole of an operation portion 209, an image-signal control portion 204, a printer control portion 205, a stacker control portion 210, and the like by the CPU 203 reading a control program stored in the ROM 207, and executing the program.

In addition, the control portion 200 includes an external I/F 201 that is an interface between the image forming apparatus body 1 and an external computer 211. The external I/F 201 receives image information (i.e., print data) from the computer 211; develops the image information into a bitmap image; and outputs the bitmap image to the image-signal control portion 204, as image data (i.e., a digital image signal). The RAM 208 temporarily stores control data, and is used as a work area for a computation process for the control. The image-signal control portion 204 receives the image data from the computer 211 via the external I/F 201; performs various processes on the image data; converts the image data to a video signal; and outputs the video signal to the printer control portion 205. The processes by the image-signal control portion 204 are controlled by the CPU circuit portion 206. The printer control portion 205 drives the above-described exposure apparatus 13 via an exposure control portion (not illustrated), depending on the inputted video signal.

The operation portion 209 includes an input portion and a display portion (such as a display panel or lamps). The input portion includes a plurality of keys or a touch panel for setting various functions for forming images. The display portion displays the information that represents the state of setting. The operation portion 209 outputs a signal that corresponds to an operation of the input portion, to the CPU circuit portion 206. In addition, the operation portion 209 displays information on the display portion, in accordance with a signal sent from the CPU circuit portion 206. A user can set the information (hereinafter referred to as sheet information) of the sheet P that represents the attribute of the sheet P, on which an image is formed by the image forming apparatus 1S, by operating the operation portion. The sheet information of the present embodiment is any one of a grammage, a size, and a material of the sheet P, or a combination thereof. For example, the material of the sheet P represents a group of coated paper sheets, plain paper sheets, or recycled paper sheets.

The stacker control portion 210 is mounted in the stacker 100 (FIG. 1). The stacker control portion 210 exchanges information with the CPU circuit portion 206, and thereby controls the whole of the stacker 100 that includes a belt driving motor 310, a belt lifting/lowering motor 311, and a sheet detection portion 312, which are mounted in the stacker 100 and will be described later. The stacker control portion 210 is one example of a control portion that controls the operation of the sheet stacking apparatus. In addition, the control portion 200 of the image forming apparatus body 1 and the stacker control portion 210 are one example of a control portion of the whole of the system that controls the operation of the image forming apparatus 1S. Note that part or all of the function of the below-described stacker control portion 210 may be embedded in the CPU circuit portion 206 of the image forming apparatus body 1 and the stacker 100 may be controlled directly by the image forming apparatus body 1.

Description of Whole of Stacker

Figure 3:
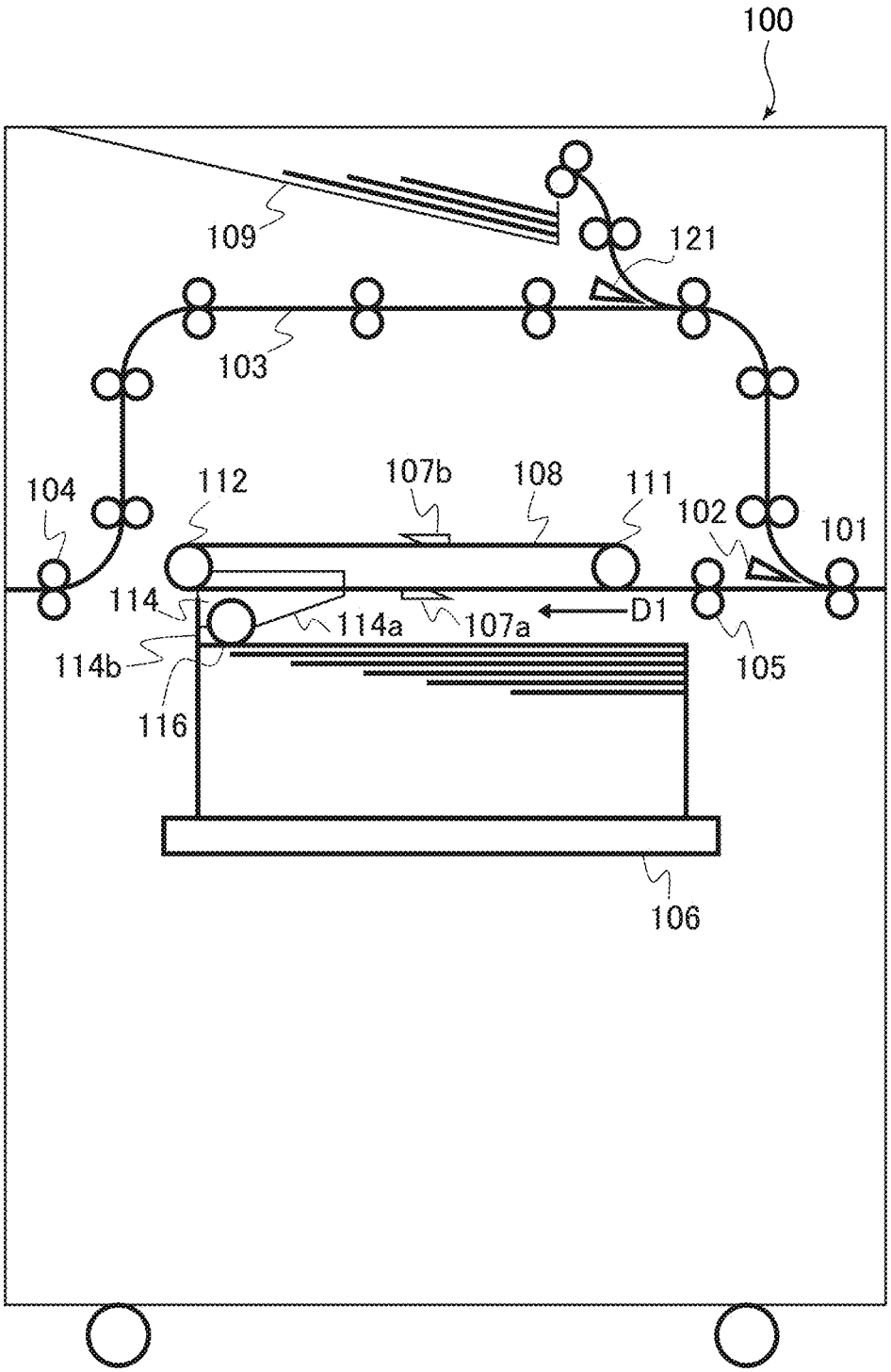
FIG. 3 is a schematic diagram of a stacker of the embodiment.

Next, the stacker 100 will be described with reference to FIG. 3. The stacker 100 includes an inlet roller pair 101, a first switching member 102, a second switching member 121, a conveyance path 103, an outlet roller pair 104, and a sample tray 109. In addition, the stacker 100 includes a discharging roller pair 105, a stacking tray 106, grippers 107*a* and 107*b*, a gripper belt 108, a leading-edge stopper 114, drawing belts 116*a*, assist belts 116*b*, and a side-edge regulation member. The leading-edge stopper 114 includes an abutment slope 114*a* and a leading-edge abutment surface 114*b*.

The stacking tray 106 is an example of a stacking portion on which the sheet P is stacked. The discharging roller pair 105, the grippers 107*a* and 107*b*, and the gripper belt 108 are an example of a conveyance portion that conveys the sheet P toward the stacking portion. The leading-edge abutment surface 114*b* of the leading-edge stopper 114 is an example of an abutting portion against which the leading edge of the sheet Pin a sheet conveyance direction D1 (i.e., the downstream edge of the sheet P in the sheet conveyance direction D1) is abutted.

The inlet roller pair 101 receives the sheet P discharged from the image forming apparatus body 1, and conveys the sheet P. The first switching member 102 switches the conveyance path of the sheet P sent from the inlet roller pair 101, between a conveyance path that extends toward the outlet roller pair 104 or the sample tray 109 and a conveyance path (stacking path) that extends toward the stacking tray 106. The second switching member 121 switches the conveyance path of the sheet P between a conveyance path 103 that extends toward the outlet roller pair 104 and a conveyance path that extends toward the sample tray 109. The outlet roller pair 104 discharges the sheet P sent through the conveyance path 103, to the outside of the stacker 100.

The discharging roller pair 105 conveys the sheet Pin the sheet conveyance direction D1, and discharges the sheet P toward the stacking tray 106. The gripper belt (i.e., a timing belt) 108 is disposed above the stacking tray 106, and stretched by and wound around a driving pulley 111 and a driven pulley 112. The gripper belt 108 is driven and rotated in a rotational direction along the sheet conveyance direction D1, by the rotation of the driving pulley 111 that is driven by a belt motor. The grippers 107*a* and 107*b* are attached to the gripper belt 108 at predetermined positions in the circumferential direction of the gripper belt 108, and rotate together with the gripper belt 108. Each of the grippers 107*a* and 107*b* can move in the sheet conveyance direction D1 in a state where the gripper holds (or nips) the leading edge of the sheet P discharged from the discharging roller pair 105.

The stacking tray 106 can move up and down in the stacker 100. The stacking tray 106 is controlled so as to move up and down in accordance with the amount of stacked sheets. For example, the stacking tray 106 is controlled so that the top surface of sheets P stacked on the stacking tray 106 is kept at a substantially predetermined height, on the basis of the detection result of a sheet-top-surface sensor that detects the sheet P at a predetermined height above the stacking tray 6.

The leading-edge stopper 114 is disposed at an edge portion of a stacking space above the stacking tray 106. The edge portion is located downstream in the sheet conveyance direction D1. The abutment slope 114*a* of the leading-edge stopper 114 projects downward from the bottom surface of the gripper belt 108, and the leading-edge abutment surface 114*b* is disposed below the abutment slope 114*a*.

The abutment slope 114*a* is a surface that abuts against the leading edge of the sheet P held by the gripper 107*a* or 107*b* and thereby separates the sheet P from the gripper 107*a* or 107*b*. The abutment slope 114*a* of the present embodiment is a sloped surface that is sloped downward toward the downstream side in the sheet conveyance direction D1. The leading-edge abutment surface 114*b* is a surface that extends in the vertical direction. The leading edge of the sheet P abuts against the leading-edge abutment surface 114*b*, so that the position of the sheet P (stacked on the stacking tray 106) in the sheet conveyance direction D1 is aligned. That is, the leading-edge abutment surface 114*b* serves as the reference of alignment of the sheet P (stacked on the stacking tray 106) in the sheet conveyance direction D1.

Figure 4A:
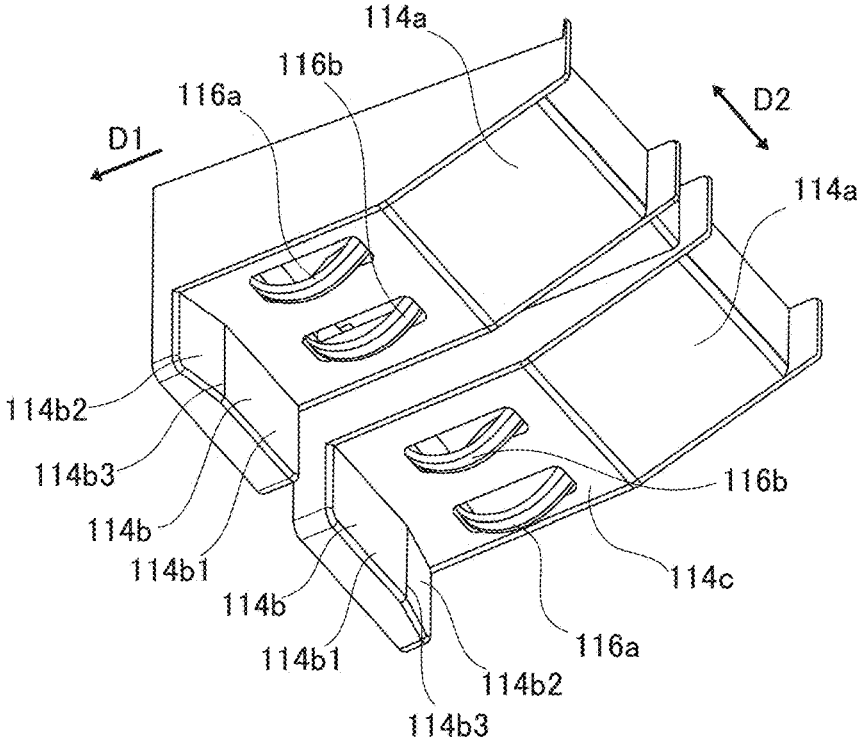
FIG. 4A is a diagram illustrating a stacking portion of the stacker of the embodiment.
Figure 4B:
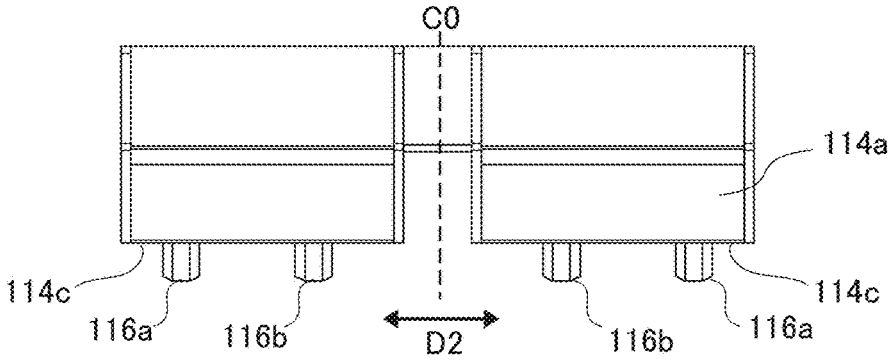
FIG. 4B is a diagram illustrating the stacking portion of the stacker of the embodiment.

As described below, in the present embodiment, a drawing belt 116*a* and another drawing belt 116*a* are disposed at positions on both sides, symmetrically with respect to a center CO of the stacking tray 106 in a sheet width direction D2 (FIG. 4B). In addition, an assist belt 116*b* and another assist belt 116*b* are disposed at positions on both sides, symmetrically with respect to the center CO of the stacking tray 106 in the sheet width direction D2. In this section (that describes the whole of the stacker), the description will be made for any one of the two drawing belts 116*a* and for any one of the two assist belts 116*b*.

The drawing belt 116*a* is disposed above the stacking tray 106. Specifically, the drawing belt 116*a* is disposed downstream of the upstream edge of the abutment slope 114*a* and upstream of the leading-edge abutment surface 114*b* in the sheet conveyance direction D1. The drawing belt 116*a* is an example of a first drawing member that draws the sheet P in the sheet conveyance direction D1 and abuts the sheet P against the abutting portion. The drawing belt 116*a* functions as a first conveyance member that contacts the sheet P stacked on the stacking tray 106 and applies the conveyance force to the sheet P so that the leading edge of the sheet P moves toward the abutting portion.

The assist belt 116*b* is an example of a second drawing member that draws the sheet P in the sheet conveyance direction D1 and abuts the sheet P against the abutting portion, in cooperation with the drawing belt 116*a*. The assist belt 116*b* functions as a second conveyance member that contacts the sheet P stacked on the stacking tray 106 and applies the conveyance force to the sheet P so that the leading edge of the sheet P moves toward the abutting portion. The detailed description of the assist belt 116*b* will be made later.

The drawing belt 116*a* is formed endless, and is made of an elastic material such as silicone rubber, ethylene-propylene-diene-monomer rubber (EPDM), or urethane rubber. The drawing belt 116*a* is disposed so that the drawing belt 116*a* elastically deforms when brought into contact with the top surface of sheets P stacked on the stacking tray 106. In other words, the position of the lowermost part of the drawing belt 116*a*, obtained when the stacking tray 106 and the stacked sheets on the stacking tray 106 are retracted downward from the drawing belt 116*a*, is located below the position of the top surface of the stacked sheets on the stacking tray 106 in the sheet stacking operation (that is, the drawing belt 116*a* enters the stacked sheets). Due to the elasticity of the drawing belt 116*a*, an appropriate contact pressure is produced when the outer circumferential surface of the drawing belt 116*a* contacts the top surface of the stacked sheets on the stacking tray 106.

The drawing belt 116*a* is referred to also as an alignment belt that aligns the sheet P. The drawing belt 116*a* may be a knurled belt on which a knurling process (i.e., a process for producing protrusions and indentations) was performed for adjusting the frictional force to the sheet P.

The side-edge regulation member is a regulation member that regulates the position of the sheet P (stacked on the stacking tray 106) in the sheet width direction. The sheet width direction is a direction orthogonal to the sheet conveyance direction D1 (i.e., a direction orthogonal to the sheet of FIG. 3). The side-edge regulation member of the present embodiment is a pair of regulation members that can move between a regulation position and a retracted position (i.e., a sheet receiving position). The regulation position is a position at which the side-edge regulation member regulates the side-edge position of the sheet P. The retracted position is a position to which the side-edge regulation member is retracted outward from the regulation position in the sheet width direction. The regulation position is set in advance so that the regulation position corresponds to a length (i.e., a sheet width) of the sheet P in the sheet width direction.

In addition, as illustrated in FIG. 2, the stacker 100 includes the belt driving motor 310 and the sheet detection portion 312. The belt driving motor 310 serves as a driving source that drives and rotates the drawing belt 116*a* and the assist belt 116*b*. The sheet detection portion 312 detects the sheet P. Furthermore, the stacker 100 includes the belt lifting/lowering motor 311 that switches the state of the assist belt 116*b* between a contact state (entering state, contact position) and a retracted state (retracted position).

The sheet detection portion 312 includes a plurality of sensors that can detect the sheet. Each sensor may be an optical sensor that is disposed at a predetermined position (detection position) on the conveyance path in the stacker 100, and that optically detects the sheet P at the detection position. The sheet detection portion 312 includes the above-described sheet-top-surface sensor. The stacker control portion 210 obtains information, such as the current position of the sheet P in the stacker 100 and the amount of sheets stacked on the stacking tray 106, on the basis of the detection signal from each sensor of the sheet detection portion 312.

Operation of Stacker

Next, the operation of the stacker 100 will be described with reference to FIG. 3. If the sheet P is discharged from the image forming apparatus body 1, the inlet roller pair 101 receives the sheet P. The sheet P is guided to a predetermined conveyance path by the first switching member 102 and the second switching member 121. The predetermined conveyance path is determined in accordance with the job setting, which is set in advance via the operation portion 209 or the like. If the place where the sheet P is to be stacked is set, in the job setting, to an apparatus (e.g., a sheet processing apparatus) connected to the stacker 100 and located downstream of the stacker 100, the sheet P passes through the conveyance path 103 and is discharged to the apparatus by the outlet roller pair 104. If the place where the sheet P is to be stacked is set, in the job setting, to the sample tray 109, the sheet P is discharged to the sample tray 109.

If the place where the sheet P is to be stacked is set, in the job setting, to the stacking tray 106, the stacker 100 performs the below-described sheet stacking operation (i.e., a stacking process). First, the sheet P sent from the inlet roller pair 101 is guided to the discharging roller pair 105 by the first switching member 102. The rotation of the gripper belt 108 is controlled so as to synchronize with the timing at which the sheet P is sent from the discharging roller pair 105, so that the leading edge of the sheet P sent from the discharging roller pair 105 is held by one of the two grippers 107*a* and 107*b*. The following description will be made for a case where the sheet P is held by the gripper 107*a*.

The sheet P is conveyed through a space above the stacking tray 106, in the sheet conveyance direction D1, in a state where the sheet P is held by the discharging roller pair 105 and the gripper 107*a*. If the leading edge of the sheet Pabuts against the abutment slope 114*a* of the leading-edge stopper 114, the leading edge of the sheet P is released from the gripper 107*a*, and the sheet P moves toward the drawing belt 116*a* and the assist belt 116*b* along the abutment slope 114*a*.

Note that the distance from a nip position of the discharging roller pair 105 to the contact position of the drawing belt 116*a* in the sheet conveyance direction D1 is shorter than the sheet length of the sheet P stacked on the stacking tray 106. The contact position is a central position of the contact area between the drawing belt 116*a* and the sheet P. The leading-edge stopper 114 and the drawing belt 116*a* are moved in advance, based on the job setting, to positions that correspond to the length (hereinafter, referred to simply as a sheet length) of the sheet P along the sheet conveyance direction D1 of the sheet P stacked on the stacking tray 106. In addition, the position (i.e., a stacking position) of the stacking tray 106 positioned when the sheet P is discharged to the stacking tray 106 is controlled so as to have a height at which the drawing belt 116*a* contacts the top surface of the stacked sheets on the stacking tray 106.

Thus, after the leading edge of the sheet P is released from the gripper 107*a* and before the trailing edge of the sheet P passes through the discharging roller pair 105, the leading edge of the sheet P contacts the drawing belt 116*a*, and receives from the drawing belt 116*a*, the force (conveyance force) applied in the sheet conveyance direction D1. Since the sheet P is moved in the sheet conveyance direction D1 by the drawing belt 116*a*, the leading edge of the sheet P is abutted against the leading-edge abutment surface 114*b* of the leading-edge stopper 114. With this operation, the position of the sheet P is aligned in the sheet conveyance direction D1. If the sheet P is skewed, the skew of the sheet P is corrected so that the leading edge of the sheet P is aligned with the leading-edge abutment surface 114*b*. The trailing edge of the sheet P passes through the discharging roller pair 105 before the leading edge of the sheet P is abutted against the leading-edge stopper 114.

In a case where the image forming apparatus 1S performs a job (consecutive jobs) in which images are consecutively formed on a plurality of sheets P and the sheets P are consecutively stacked on the stacker 100, the above-described operation is performed repeatedly. In a case where a user takes out the sheets P from the stacker 100, the user operates the operation portion 209 (or an open-and-close button disposed on the stacker 100), and thereby sets the state of the stacker 100 to an open state. In this case, the stacker control portion 210 (FIG. 2) that has received the user operation lowers the stacking tray 106 from the stacking position to a lower position at which the user can take out the sheets P. Then the stacker control portion 210 allows the user to access the stacking tray 106, for example, by unlocking the door.

Note that the side-edge regulation member is driven such that the side-edge regulation member moves to the retracted position before the sheet P is discharged to the stacking tray 106, and moves to the regulation position after the leading edge of the sheet P is abutted against the leading-edge abutment surface 114*b* of the leading-edge stopper 114. With these operations, the alignment of the stacked sheets on the stacking tray 106 is kept in the sheet conveyance direction D1 and the sheet width direction.

Operation by Drawing Belt Alone

Figure 9A:
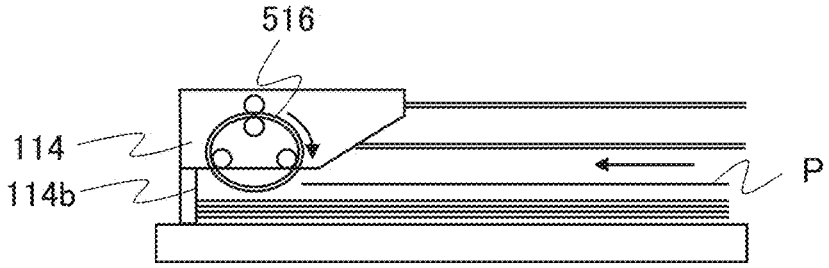
FIG. 9A is a diagram for illustrating a stacker of a comparative example.
Figure 9B:
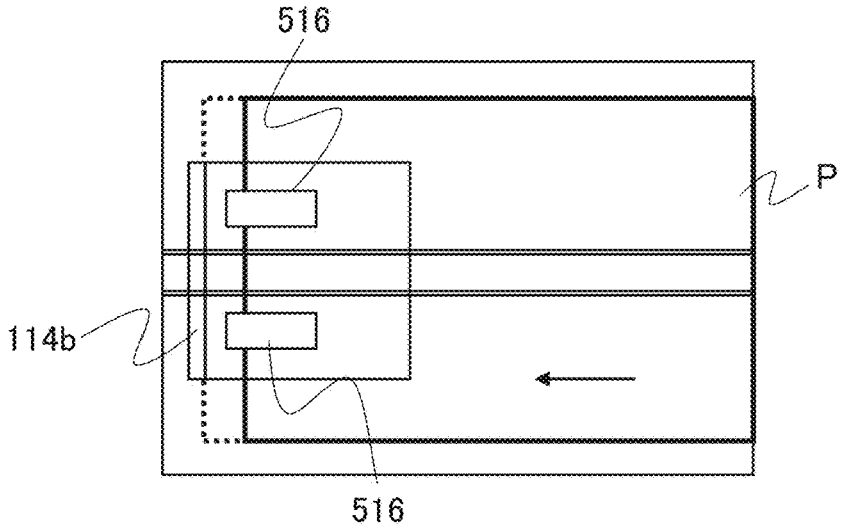
FIG. 9B is a diagram for illustrating the stacker of the comparative example.

Next, a comparative example in which the assist belt 116*b* is not disposed will be described. Each of FIGS. 9A to 9C illustrates a state where a stacker of the comparative example is performing a sheet stacking operation.

In the comparative example, the assist belt 116*b* is not disposed. Thus, as illustrated in FIG. 9A, the sheet P is abutted against the leading-edge abutment surface 114*b* of the leading-edge stopper 114 by the conveyance force of a drawing belt 516 alone. The magnitude of the conveyance force applied to the sheet P by the drawing belt 516 can be adjusted, for example, by changing the contact pressure of the drawing belt 516 to the sheet P. The contact pressure can be changed by adjusting the amount of entering of the drawing belt 516 with respect to the position of the top surface of the stacked sheets positioned in the sheet stacking operation. The amount of entering is the amount of projection of the lowermost part of the drawing belt 516 in a state where the stacking tray 106 and the stacked sheets are lowered to a position at which the stacking tray 106 and the stacked sheets do not contact the drawing belt 516, with respect to the position of the top surface of the stacked sheets in the sheet stacking operation. However, in the comparative example, it is not possible to change the magnitude of the conveyance force, which is applied to the sheet P by the drawing belt 516, in accordance with the attribute of the sheet P.

Thus, if the conveyance force is set in accordance with a sheet P with less weight, the conveyance force may be insufficient for a sheet P with more weight. In this case, as illustrated in FIG. 9B, the leading edge of the sheet P may not reach the leading-edge abutment surface 114*b*, causing the failure of alignment. For example, the sheet P with less weight is a sheet with less size (area), a sheet with less grammage, or a sheet (such as a recycled paper sheet) made of a material with less density. A specific example of the sheet P with less weight is a business form.

Figure 9C:
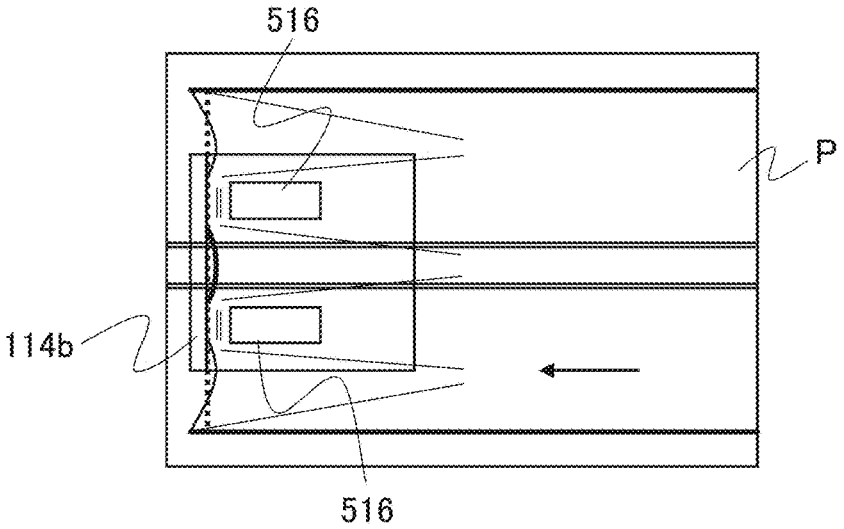
FIG. 9C is a diagram for illustrating the stacker of the comparative example.

In contrast, if the conveyance force is set in accordance with a sheet P with more weight, the conveyance force may be excessive for a sheet P with less weight, as illustrated in FIG. 9C. In this case, the sheet P may be bent or buckled by the conveyance force that the sheet P receives from the drawing belt 516, and by the reaction force that the sheet P receives from the leading-edge abutment surface 114*b*, so that the alignment may deteriorate. Since the sheet P with less weight has a lower rigidity (Young's modulus), the bending or buckling easily occurs to the sheet P. For example, the sheet P with more weight is a sheet with more size (area), a sheet with more grammage, or a sheet (such as a coated paper sheet) made of a material with more density. A specific example of the sheet P with more weight is a packaging sheet.

Thus, in the present embodiment, the assist belt 116*b* that can be retracted is used in addition to the drawing belt 116*a*, for achieving the better alignment for more various types of sheets.

Assist Belt

Figure 4C:
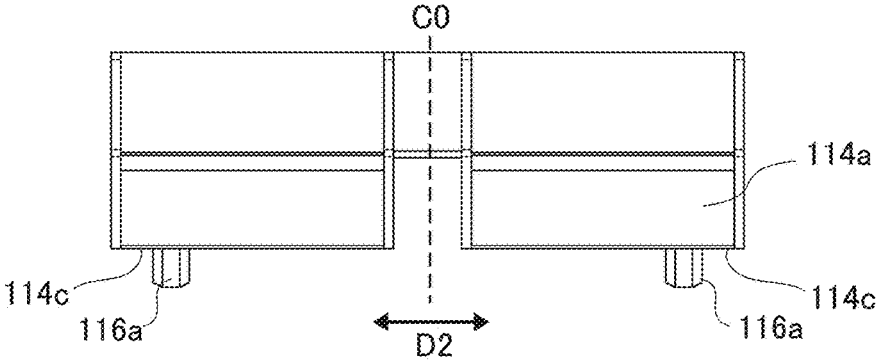
FIG. 4C is a diagram illustrating the stacking portion of the stacker of the embodiment.
Figure 5A:
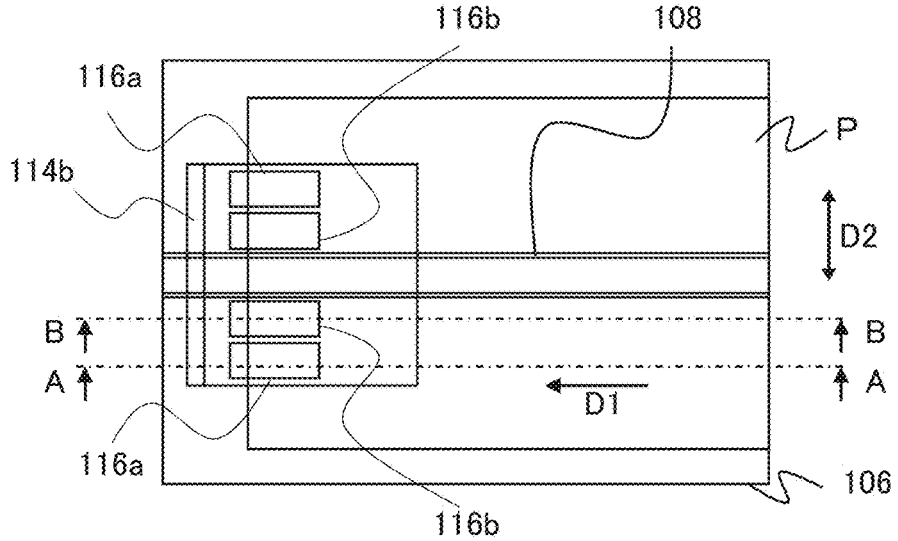
FIG. 5A is a diagram illustrating the stacker of the embodiment.
Figure 5B:
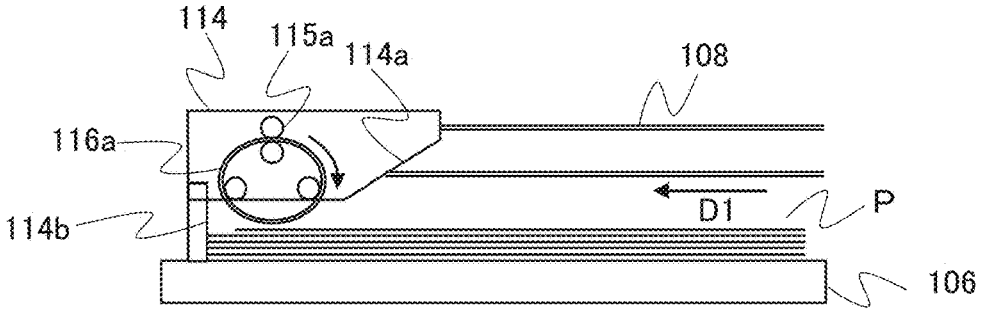
FIG. 5B is a diagram illustrating the stacker of the embodiment.

Next, the assist belt 116*b* will be described with reference to FIGS. 4A to 4C and FIGS. 5A to 5D. FIG. 4A is a perspective view illustrating a stacking unit of the stacker 100. The stacking unit is a unit that includes the drawing belt 116*a*, the assist belt 116*b*, and the leading-edge stopper 114. Each of FIGS. 4B and 4C is a diagram of the stacking unit viewed from the upstream side in the sheet conveyance direction D1. FIG. 5A is a schematic diagram of the stacker 100 viewed from above. FIG. 5B is a cross-sectional view taken along a line A-A of FIG. 5A. Each of FIGS. 5C and 5D is a cross-sectional view taken along a line B-B of FIG. 5A.

As illustrated in FIGS. 4A and 4B and FIG. 5A, the assist belt 116*b* is disposed alongside the drawing belt 116*a* in the sheet width direction D2. In the present embodiment, a drawing belt 116*a* and another drawing belt 116*a* are disposed at positions on both sides, symmetrically with respect to the center CO of the stacking tray 106 in the sheet width direction D2. In addition, an assist belt 116*b* and another assist belt 116*b* are disposed at positions on both sides, symmetrically with respect to the center CO of the stacking tray 106 in the sheet width direction D2. If one drawing belt 116*a* is referred to as a first drawing member and one assist belt 116*b* is referred to as a second drawing member, the other drawing belt 116*a* is an example of a third drawing member (or a third conveyance member) and the other assist belt 116*b* is an example of a fourth drawing member (or a fourth conveyance member).

As illustrated in FIG. 5B, the drawing belt 116*a* is nipped by a driving-roller pair 115*a*. The driving-roller pair 115*a* is driven and rotated by the belt driving motor 310 (FIG. 2). By the rotation of the driving-roller pair 115*a*, the drawing belt 116*a* is driven and rotated in a clockwise direction in FIG. 5B (that is, in a rotational direction in which a lower portion of the drawing belt 116*a* moves from the upstream side to the downstream side in the sheet conveyance direction D1). Note that the inner circumferential surface of the drawing belt 116*a* is guided by guide rollers disposed at positions different from the position of the driving-roller pair 115*a*.

Figure 5C:
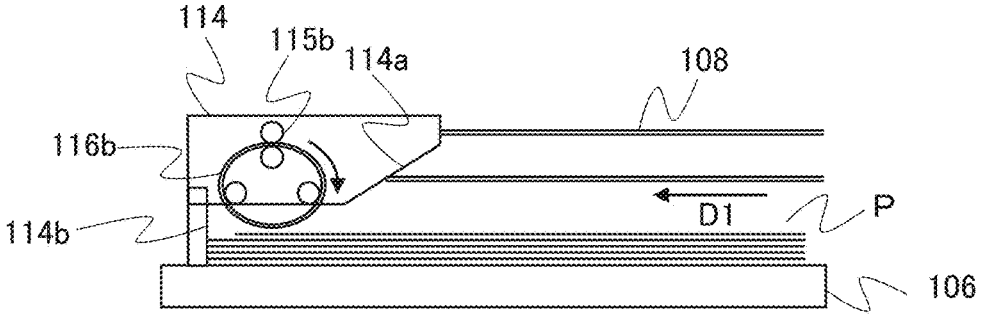
FIG. 5C is a diagram illustrating the stacker of the embodiment.
Figure 5D:
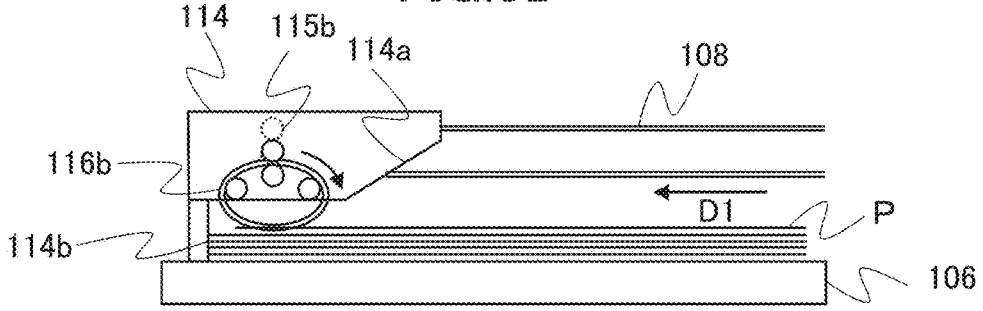
FIG. 5D is a diagram illustrating the stacker of the embodiment.

As illustrated in FIG. 5C, the assist belt 116*b* is nipped by a driving-roller pair 115*b*. The driving-roller pair 115*b* is driven and rotated by the belt driving motor 310 (FIG. 2). The driving-roller pair 115*b* is an example of a roller pair that nips the second drawing member. By the rotation of the driving-roller pair 115*b*, the assist belt 116*b* is driven and rotated in a clockwise direction in FIG. 5C (that is, in a rotational direction in which a lower portion of the assist belt 116*b* moves from the upstream side to the downstream side in the sheet conveyance direction D1). Note that the inner circumferential surface of the assist belt 116*b* is guided by guide rollers disposed at positions different from the position of the driving-roller pair 115*b*.

In addition, as illustrated in FIGS. 5C and 5D, the driving-roller pair 115*b* can be moved up and down by the driving force of the belt lifting/lowering motor 311 (FIG. 2). When the driving-roller pair 115*b* is positioned at a position (upper position, waiting position) illustrated in FIG. 5C, the assist belt 116*b* is retracted (separated) upward from the top surface of the sheet P stacked on the stacking tray 106. When the driving-roller pair 115*b* is positioned at a position (lower position, working position) illustrated in FIG. 5D, the assist belt 116*b* is in contact with the top surface of the sheet P stacked on the stacking tray 106. The belt lifting/lowering motor 311 is an example of a driving portion that lifts and lowers the roller pair with respect to the stacking portion, for switching the state of the second drawing member between a contact state (contact position) and a retracted state (retracted position).

The position and the state (FIG. 5C) of the assist belt 116*b* obtained when the driving-roller pair 115*b* is positioned at the upper position are respectively referred to as a retracted position and a retracted state. In addition, the position and the state (FIG. 5D) of the assist belt 116*b* obtained when the driving-roller pair 115*b* is positioned at the lower position are respectively referred to as a contact position and a contact state. Thus, the assist belt 116*b* of the present embodiment is disposed so that the state of the assist belt 116*b* can be switched between the contact state and the retracted state (that is, the assist belt 116*b* can be moved between the contact position and the retracted position). In other words, the contact state is an entering state in which the assist belt 116*b* enters the sheets stacked on the stacking tray 106, by a predetermined amount of entering.

As illustrated in FIGS. 4A and 4B, the assist belt 116*b* in the contact state projects downward from a downward-facing surface 114*c* of the leading-edge stopper 114, through an opening formed in the downward-facing surface 114*c*. As illustrated in FIG. 4C, the assist belt 116*b* in the retracted state is retracted upward from the downward-facing surface 114*c* of the leading-edge stopper 114. In the retracted state, however, one portion of the assist belt 116*b* in the retracted state may be positioned at a position lower than the downward-facing surface 114*c* if the assist belt 116*b* does not substantially apply the conveyance force to the sheet P in the retracted state.

In the present embodiment, the drawing belt 116*a* always projects downward from the downward-facing surface 114*c* of the leading-edge stopper 114, and the state of the drawing belt 116*a* is not switched between the contact state and the retracted state. The amount of entering of the drawing belt 116*a* with respect to the sheets stacked on the stacking tray 106 is almost equal to the amount of entering of the assist belt 116*b* in the contact state, with respect to the sheets stacked on the stacking tray 106.

Preferably, the assist belt 116*b* is positioned inner than the drawing belt 116*a* in the sheet width direction D2 (that is, the assist belt 116*b* is disposed closer to the center CO than the drawing belt 116*a* is). This is because the pivot (skew) of the sheet P is less caused in a case where the assist belt 116*b* is in the retracted state, and where the sheet P is drawn by the drawing belt 116*a* alone. In the case where the assist belt 116*b* is in the retracted state, and where the sheet P is drawn by the drawing belt 116*a* alone, the moving speed of a right portion of the sheet P and the moving speed of a left portion of the sheet P may be different from each other due to the difference in circumference or coefficient of friction between one drawing belt 116*a* and the other drawing belt 116*a*. The difference may cause the pivot (skew) of the sheet P. In this case, if the distance between one drawing belt 116*a* and the other drawing belt 116*a* in the sheet width direction D2 has a small value, the sheet P easily pivots (skews). The distance between one drawing belt 116*a* and the other drawing belt 116*a* in the sheet width direction D2 in a case where the assist belt 116*b* is positioned inner than the drawing belt 116*a* is larger than the distance between one drawing belt 116*a* and the other drawing belt 116*a* in the sheet width direction D2 in a case where the assist belt 116*b* is positioned outer than the drawing belt 116*a*. Thus, in the arrangement in the present embodiment, the pivot (skew) of the sheet P can be reduced.

In addition, it is preferable that the drawing belt 116*a* and the assist belt 116*b* are positioned inner than the side-edge positions of the sheet whose sheet width in the sheet width direction D2 is shortest among the sheets P that can be stacked on the stacking tray 106 by the stacker 100. With this arrangement, the sheet P can be drawn by the drawing belt 116*a* and the assist belt 116*b*, regardless of the type of the sheet P stacked on the stacking tray 106.

In the present embodiment, the sheet contact area of the drawing belt 116*a* in the sheet conveyance direction D1 and the sheet contact area of the assist belt 116*b* in the sheet conveyance direction D1 are substantially the same as each other. The sheet contact area of the drawing belt 116*a* is an area in which the drawing belt 116*a* contacts the top surface of the stacked sheets on the stacking tray 106, in a state where the top surface of the stacked sheets is kept at a predetermined height in the sheet stacking operation. The sheet contact area of the assist belt 116*b* is an area in which the assist belt 116*b* in the contact state (contact position) contacts the top surface of the stacked sheets on the stacking tray 106, in a state where the top surface of the stacked sheets is kept at a predetermined height in the sheet stacking operation.

Sequence of Sheet Stacking Operation

Figure 6:
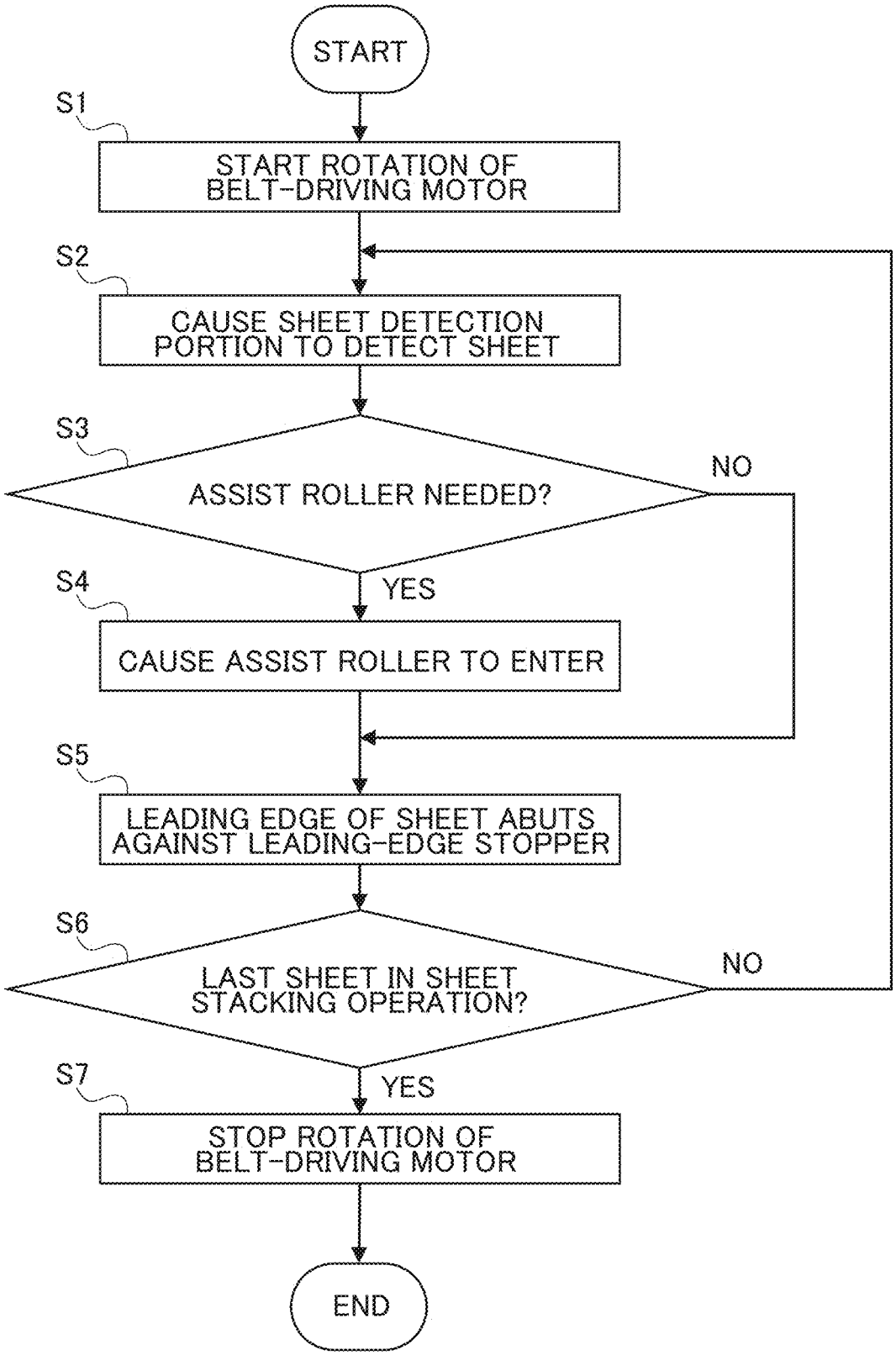
FIG. 6 is a flowchart illustrating an example of control of a sheet stacking operation of the embodiment.

Next, a sequence of the sheet stacking operation will be described. FIG. 6 is a flowchart illustrating an example of control of the sheet stacking operation of the present embodiment. Each process illustrated in the below-described flowchart is performed by the stacker control portion 210, unless otherwise specified, depending on an instruction from the control portion 200 of the image forming apparatus body 1.

If an image forming job that include a job setting for stacking the sheet P on the stacking tray 6 is given to the image forming apparatus 1S, the stacker control portion 210 starts the sheet stacking operation, depending on an instruction from the control portion 200 of the image forming apparatus body 1. Then the stacker control portion 210 starts the rotation of the drawing belt 116*a* and the assist belt 116*b* by rotating the belt driving motor 310 (S1).

A single sheet P (hereinafter referred to as a current sheet P) is discharged from the image forming apparatus body 1, and is conveyed toward the stacking tray 106 by the discharging roller pair 105. In the process in which the current sheet P is conveyed, the position information of the sheet P is detected by the sheet detection portion 312 (S2). The sheet P is conveyed in a state where the sheet P is held by the gripper 107*a* or 107*b* attached to the gripper belt 108, and is released from the gripper 107*a* or 107*b* by the leading edge of the sheet P abutting against the abutment slope 14*a* of the leading-edge stopper 114.

The stacker control portion 210 determines which of the contact state and the retracted state the stacker control portion 210 will set the state of the assist belt 116*b* to (that is, determines the need for the assist belt 116*b* to enter), on the basis of the sheet information that is specified in advance when the job is given (S3). If the stacker control portion 210 determines to set the state of the assist belt 116*b* to the contact state (S3: YES), then the stacker control portion 210 causes the belt lifting/lowering motor 311 to move the driving-roller pair 115*b* to the lower position, and sets the state of the assist belt 116*b* to the contact state (S4). That is, the stacker control portion 210 positions the assist belt 116*b* at the contact position. For example, the timing at which the state of the assist belt 116*b* is set to the contact state is a timing at which the sheet P abuts against the abutment slope 114*a* of the leading-edge stopper 114. In this case, the sheet P is drawn and abutted against the leading-edge abutment surface 114*b* of the leading-edge stopper 114 by both of the drawing belt 116*a* and the assist belt 116*b* (S5, FIG. 5D).

If the stacker control portion 210 determines to set the state of the assist belt 116*b* to the retracted state (S3: NO), then the stacker control portion 210 keeps the assist belt 116*b* in the retracted state by keeping the driving-roller pair 115*b* in the upper position. That is, the stacker control portion 210 positions the assist belt 116*b* at the retracted position. In this case, the sheet P is drawn and abutted against the leading-edge abutment surface 114*b* of the leading-edge stopper 114 by the drawing belt 116*a* (S5, FIG. 5C).

If the current sheet P is not the last sheet in the sheet stacking operation (S6: NO), then the stacker control portion 210 returns to the step S2 and repeats the same processes (S2 to S5) for each sheet. If the current sheet P is the last sheet in the sheet stacking operation (S6: YES), then the stacker control portion 210 stops the rotation of the drawing belt 116*a* and the assist belt 116*b*, and ends the sheet stacking operation (S7).

In the present embodiment, the criterion for determining, in the step S3, the need for the assist belt 116*b* to enter is set in advance. That is, the state of the assist belt 116*b* is set to the contact state for a sheet P with more weight, and to the retracted state for a sheet P with less weight. A table of FIG. 7 shows an example of the criterion for determining the need for the assist belt 116*b* to enter, and the criterion is set in accordance with the sheet information. In this example, the need for the assist belt 116*b* to enter is determined, based on the size and grammage of a sheet. In FIG. 7, a symbol "Yes" indicates the contact state (contact position), and a symbol "No" indicates the retracted state (retracted position).

Note that since the criterion of determination illustrated in FIG. 7 is one example, the threshold of the need for the assist belt 116*b* to enter may be changed in accordance with a specific configuration of the stacker 100 (e.g., the material of the drawing belt 116*a* and the assist belt 116*b*, the coefficient of friction of the drawing belt 116*a* and the assist belt 116*b* to the sheet, or the contact pressure of the drawing belt 116*a* and the assist belt 116*b* to the sheet P). In addition, although FIG. 7 illustrates an example in which the size and grammage of the sheet are used as the sheet information, the need for the assist belt 116*b* to enter may be determined, based on the material of the sheet or another attribute of the sheet.

Thus, in the present embodiment, the assist belt 116*b* whose state can be switched between the contact state (contact position) and the retracted state (retracted position) is disposed. In addition, the stacker control portion 210 can execute a mode in which the sheet P is drawn by both of the drawing belt 116*a* and the assist belt 116*b* (S3: YES, S4), and a mode in which the sheet P is drawn by the drawing belt 116*a* alone (S3: NO). In other words, the control portion of the present embodiment can execute a first mode in which the control portion sets the state of the second drawing member to the contact state and causes the first drawing member and the second drawing member to convey the sheet, and a second mode in which the control portion sets the state of the second drawing member to the retracted state and causes the first drawing member to convey the sheet. In other words, the control portion can execute a first mode in which the second conveyance member is positioned at the contact position and the sheet is conveyed by the first conveyance member and the second conveyance member, and a second mode in which the second conveyance member is positioned at the retracted position and the sheet is conveyed by the first conveyance member.

Thus, in the present embodiment, good alignment can be achieved for more various types of sheets, by appropriately using the first mode and the second mode.

For example, the state of the assist belt 116*b* is set to the contact state (the first mode) for a sheet with more weight. In this case, even if the conveyance force of the drawing belt 116*a* alone is insufficient, the sheet P can be more reliably abutted against the leading-edge abutment surface 114*b*. As a result, the possibility of the failure of alignment can be reduced. In addition, the state of the assist belt 116*b* is set to the retracted state (the second mode) for a sheet with less weight. In this case, it can be possible to avoid the excessive conveyance force. As a result, the possibility of bending or buckling of the sheet P, which occurs between the belts (the drawing belt 116*a* and the assist belt 116*b*) and the leading-edge abutment surface 114*b*, can be reduced, and the alignment for the sheet with less weight can be improved.

In addition, in the present embodiment, the stacker control portion 210 determines the need for the assist belt 116*b* to enter, on the basis of the sheet information that is specified in advance when the job is given. In other words, the control portion of the present embodiment determines which of the first mode and the second mode the control portion will execute, on the basis of the sheet information on a sheet stacked on the stacking portion. With this operation, the control portion can execute an appropriate mode in accordance with the sheet information.

In addition, as illustrated in FIG. 7, if the sheet size is constant (e.g., A3 size), the state of the assist belt 116*b* is set to the contact state if the sheet has a larger grammage (equal to or larger than 350 gsm), and to the retracted state if the sheet has a smaller grammage (smaller than 350 gsm). In other words, the control portion of the present embodiment executes the first mode if a sheet with a first grammage is to be stacked, and executes the second mode if a sheet with a second grammage smaller than the first grammage is to be stacked. With this operation, the control portion can execute an appropriate mode in accordance with the difference in grammage.

In addition, as illustrated in FIG. 7, if the sheet grammage is constant (e.g., 200 to 250 gsm), the state of the assist belt 116*b* is set to the contact state if the sheet has a larger size (e.g., B3 size), and to the retracted state if the sheet has a smaller size (e.g., B4 size). In other words, the control portion of the present embodiment executes the first mode if a sheet with a first size is to be stacked, and executes the second mode if a sheet with a second size whose area is smaller than that of the first size is to be stacked. With this operation, the control portion can execute an appropriate mode in accordance with the difference in size.

In addition, in the present embodiment, the state of the assist belt 116*b* can be set to the contact state if a sheet (e.g., a coated paper sheet) made of a material with more density is to be stacked, and to the retracted state if a sheet (e.g., a plain paper sheet or a recycled paper sheet) made of a material with less density is to be stacked. In other words, the control portion of the present embodiment executes the first mode if a sheet of a first material is to be stacked, and executes the second mode if a sheet of a second material whose density is smaller than that of the first material is to be stacked. With this operation, the control portion can execute an appropriate mode in accordance with the difference in material.

Tapered Portion of Leading-Edge Abutment Surface

Next, the positional relationship between a tapered portion formed in the leading-edge abutment surface 114*b*, and the drawing belt 116*a* and the assist belt 116*b* will be described.

As illustrated in FIG. 4A, the leading-edge abutment surface 114*b* of the leading-edge stopper 114 includes an alignment surface 114*b*1 and a tapered portion (sloped surface) 114*b*2. The alignment surface 114*b*1 extends almost perpendicular to the sheet conveyance direction D1. The tapered portion 114*b*2 is sloped with respect to the alignment surface 114*b*1. The alignment surface 114*b*1 is a first surface that extends in the sheet width direction D2. The tapered portion 114*b*2 is a second surface that is adjacent to and on the outside of the first surface in the sheet width direction D2, and that is sloped downstream in the sheet conveyance direction D1 toward the outside in the sheet width direction D2.

Preferably, a boundary 114*b*3 between the alignment surface 114*b*1 and the tapered portion 114*b*2 is positioned outer than the assist belt 116*b* and inner than the drawing belt 116*a* in the sheet width direction D2. The reason for such a positional relationship will be described with reference to FIG. 8.

Figure 8:
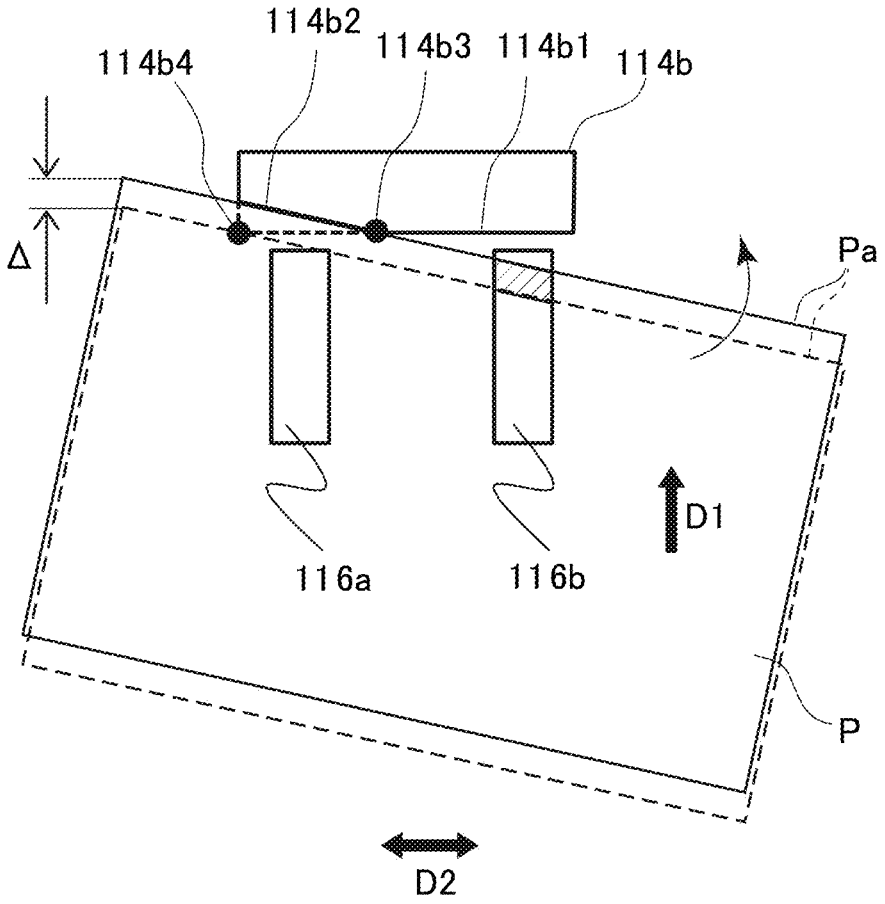
FIG. 8 is a diagram for illustrating a tapered portion of a leading-edge abutment surface.

FIG. 8 is a schematic diagram illustrating the left drawing belt 116*a*, the left assist belt 116*b*, and one portion of the leading-edge abutment surface 114*b*, which are illustrated in FIG. 4. As described above, the leading-edge abutment surface 114*b* of the present embodiment includes the alignment surface 114*b*1 and the tapered portion 114*b*2. When the sheet P is aligned, the sheet P is pivoted by the conveyance force that the sheet P receives from the drawing belt 116*a* and the assist belt 116*b* in the sheet conveyance direction D1. Specifically, the sheet P is pivoted so that the leading edge Pa of the sheet P is aligned with the alignment surface 114*b*1, so that the skew of the sheet P is corrected.

As indicated by a broken line of FIG. 8, in a comparative example in which the tapered portion is not formed in the leading-edge abutment surface 114*b*, a leading edge Pa of the sheet P pivots, with an outer edge 114*b*4 of the alignment surface 114*b*1 serving as a fulcrum. In contrast, in the present embodiment, as indicated by a solid line, since the tapered portion is formed in the leading-edge abutment surface 114*b*, a leading edge Pa of the sheet P pivots, with the boundary 114*b*3 between the alignment surface 114*b*1 and the tapered portion 114*b*2 serving as a fulcrum.

Thus, if the slope of the sheet P is constant, the position at which the sheet P starts to pivot in the present embodiment is downstream of the position at which the sheet P starts to pivot in the comparative example, in the sheet conveyance direction D1 (the difference between the positions is denoted by Δ). As a result, as illustrated in a hatched area of FIG. 8, the area in which the assist belt 116*b* contacts the sheet Pin the start of pivot of the sheet P can be increased, so that the sheet P can pivot easily. The state of the assist belt 116*b* is set to the contact state typically when a sheet P with more weight is conveyed. Since the contact area is increased, the conveyance force can be more efficiently applied to the sheet P. That is, due to the position of the boundary 114*b*3 between the alignment surface 114*b*1 and the tapered portion 114*b*2 of the present embodiment, the skew of the sheet P can be more easily corrected by the leading-edge abutment surface 114*b*.

Note that the area in which a drawing belt 116*a* and an assist belt 116*b*, opposite to the drawing belt 116*a* and the assist belt 116*b* of FIG. 8 with respect to the center of the stacking tray 106, contact the sheet P is also increased. Thus, the skew of the sheet P can be more easily corrected by the leading-edge abutment surface 114*b*.

Modifications

In the above-described embodiment, the description has been made for an example in which the timing (S4) at which the state of the assist belt 116*b* is set to the contact state is a timing at which the sheet Pabuts against the abutment slope 114*a* of the leading-edge stopper 114. However, the present disclosure is not limited to this. The timing at which the state of the assist belt 116*b* is set to the contact state has only to be a timing at which the assist belt 116*b* can apply the conveyance force to the sheet P before the sheet P abuts against the leading-edge abutment surface 114*b*. For example, the state of the assist belt 116*b* may be set to the contact state at a timing at which the leading edge of the sheet P is detected by the sheet detection portion 312.

In addition, in the above-described embodiment, the description has been made for the case where the state of the assist belt 116*b* is switched between the two states, the contact state and the retracted state. In addition to this, the state of the assist belt 116*b* may be switched to an intermediate state. That is, in the intermediate state (i.e., a light contact state), the assist belt 116*b* may be in contact with the sheet stacked on the stacking tray 106, at a contact pressure lower than a contact pressure at which the assist belt 116*b* is in contact with the sheet in the contact state. Specifically, the driving-roller pair 115*b* of the assist belt 116*b* is moved to an intermediate position between the upper position (FIG. 5C) and the lower position (FIG. 5D). In this case, it is preferable that the state of the assist belt 116*b* be set to the intermediate state for a sheet whose weight is smaller than that of a sheet for which the state of the assist belt 116*b* is set to the contact state, and is larger than that of a sheet for which the state of the assist belt 116*b* is set to the retracted state.

In other words, the state of the second drawing member may be switched to the intermediate state in which the second drawing member is in contact with the sheet stacked on the stacking portion, at a contact pressure lower than that in the contact state. In addition, the control portion may execute a third mode in which the state of the second drawing member is set to the intermediate state and the sheet is drawn by the first drawing member and the second drawing member. In addition, the second conveyance member may move to the intermediate position at which the second conveyance member contacts the sheet stacked on the stacking portion, at a contact pressure lower than that at the contact position. In addition, the control portion may execute the third mode in which the control portion positions the second conveyance member at the intermediate position and causes the first conveyance member and the second conveyance member to convey the sheet. In this manner, good alignment can be achieved for more various types of sheets, by appropriately using the first mode, the second mode, and the third mode.

Note that the contact pressure of the assist belt 116*b* to the sheet P may be changed in three or more stages. In another case, a plurality of sets of assist belts 116*b* may be disposed. In this case, the number of sets of assist belts 116*b* that are in the contact state may be changed, and thereby the conveyance force applied to the sheet P may be changed in three or more stages, by the whole of the plurality of sets of assist belts 116*b*. In addition, the state of the drawing belt 116*a* may be switched between the contact state and the retracted state in the configuration in which the state of the assist belt 116*b* is switched between the contact state and the retracted state.

In addition, in the above-described embodiment, the description has been made for the example in which the sheet contact area of the drawing belt 116*a* in the sheet conveyance direction D1 and the sheet contact area of the assist belt 116*b* in the sheet conveyance direction D1 are substantially the same as each other. Instead of this, the sheet contact area of the assist belt 116*b* may be shifted downstream relative to the sheet contact area of the drawing belt 116*a* in the sheet conveyance direction D1. For example, the position of an upstream edge portion of the sheet contact area of the assist belt 116*b* may be shifted downstream from the position of an upstream edge portion of the sheet contact area of the drawing belt 116*a*, by a few millimeters in the sheet conveyance direction D1. In this case, the drawing belt 116*a* contacts the sheet P conveyed to the stacking portion, earlier than the assist belt 116*b* contacts the sheet P, regardless of the contact state or the retracted state of the assist belt 116*b*. If the assist belt 116*b* contacts the sheet earlier than the drawing belt 116*a* contacts the sheet, the sheet will pivot easily, for example. Such inconvenience can be avoided by the above-described arrangement, so that the behavior of the sheet can be stabilized more.

In addition, in the above-described embodiment, the description has been made for the example in which the assist belt 116*b* is positioned inner than the drawing belt 116*a* in the sheet width direction D2. However, the present disclosure is not limited to this. For example, the assist belt 116*b* may be positioned outer than the drawing belt 116*a* in the sheet width direction D2.

In addition, in the above-described embodiment, the description has been made for the example in which both of the first drawing member and the second drawing member are endless belts having elasticity. However, each of the first drawing member and the second drawing member is not limited to a belt, and may be a roller member or a paddle member in which elastic projections (paddles) are formed on a rotary shaft. In another case, the type of the first drawing member and the type of the second drawing member may be different from each other. For example, the first drawing member may be a belt, and the second drawing member may be a roller member.

In addition, in the description for the flowchart of FIG. 6, the description has been made for the case where the assist belt 116*b* is rotated even when the assist belt 116*b* is in the retracted state. However, when the state of the assist belt 116*b* is set to the retracted state, the rotation of the assist belt 116*b* may be stopped. In this case, a clutch portion, such as an electromagnetic clutch, may be disposed in the driving-force transmission path between the belt driving motor 310 and the driving-roller pair 115*b*. In another case, a motor for rotating the assist belt 116*b* may be disposed in addition to a belt driving motor 310 for rotating the drawing belt 116*a*.

In the above-described embodiment, the description has been made, as an example, for the configuration in which the leading edge of the sheet is held by the gripper 107*a* or 107*b*, and in which the leading edge of the sheet is released from the gripper 107*a* or 107*b* by the leading edge of the sheet abutting against the abutment slope 114*a*. However, the present disclosure is not limited to this. For example, a configuration in which the grippers 107*a* and 107*b* can open and close may be used. In this configuration, the sheet may be released from the gripper 107*a* or 107*b* by the gripper 107*a* or 107*b* being opened when the leading edge of the sheet approaches the leading-edge abutment surface 114*b*.

In another case, the grippers 107*a* and 107*b* and the gripper belt 108 may not be disposed, and the discharging roller pair 105 may directly convey the sheet onto the stacking tray 6. In another case, the direction in which the discharging roller pair 105 conveys the sheet may be different from the direction in which the drawing belt 116*a* conveys the sheet. For example, the discharging roller pair 105 may convey the sheet in a direction opposite to the direction in which the drawing belt 116*a* moves the sheet toward the leading-edge stopper 114, and discharge the sheet to the stacking tray 106. In this case, the sheet discharged to the stacking tray 106 may be moved toward the leading-edge stopper 114 in the sheet conveyance direction by a conveyance member (such as a paddle or a roller), and then the sheet may be abutted against the leading-edge stopper 114 by the drawing belt 116*a*.

The present disclosure can provide a sheet stacking apparatus and an image forming apparatus that can achieve good alignment for more various types of sheets.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-091931, filed on Jun. 2, 2023, which is hereby incorporated by reference herein in its entirety.

What is claimed is:

1. A sheet stacking apparatus comprising:

a stacking portion on which a sheet is stacked;

a conveyance portion configured to convey the sheet toward the stacking portion in a sheet conveyance direction;

an abutting portion against which a leading edge of the sheet in the sheet conveyance direction is abutted;

a first conveyance member configured to contact the sheet stacked on the stacking portion and apply conveyance force to the sheet for moving the leading edge of the sheet toward the abutting portion;

a second conveyance member configured to contact the sheet stacked on the stacking portion and apply conveyance force to the sheet for moving the leading edge of the sheet toward the abutting portion, the second conveyance member being movable to a contact position at which the second conveyance member contacts the sheet stacked on the stacking portion and to a retracted position to which the second conveyance member is retracted from the sheet stacked on the stacking portion; and a control portion configured to execute a first mode and a second mode, the first mode being a mode in which the second conveyance member is positioned at the contact position such that the sheet is conveyed by the first conveyance member and the second conveyance member, the second mode being a mode in which the second conveyance member is positioned at the retracted position such that the sheet is conveyed by the first conveyance member.

2. The sheet stacking apparatus according to claim 1, wherein the control portion is configured to determine which of the first mode and the second mode the control portion will execute, on a basis of sheet information on a sheet to be stacked on the stacking portion.

3. The sheet stacking apparatus according to claim 1, wherein the control portion is configured to execute the first mode if a sheet with a first grammage is to be stacked, and execute the second mode if a sheet with a second grammage smaller than the first grammage is to be stacked.

4. The sheet stacking apparatus according to claim 1, wherein the control portion is configured to execute the first mode if a sheet with a first size is to be stacked, and execute the second mode if a sheet with a second size whose area is smaller than that of the first size is to be stacked.

5. The sheet stacking apparatus according to claim 1, wherein the control portion is configured to execute the first mode if a sheet of a first material is to be stacked, and execute the second mode if a sheet of a second material whose density is smaller than that of the first material is to be stacked.

6. The sheet stacking apparatus according to claim 1, wherein the second conveyance member is disposed alongside the first conveyance member in a sheet width direction orthogonal to the sheet conveyance direction.

7. The sheet stacking apparatus according to claim 6, wherein the second conveyance member is positioned inner than the first conveyance member in the sheet width direction.

8. The sheet stacking apparatus according to claim 7, wherein the abutting portion includes:

a first surface extending in the sheet width direction, and a second surface that is adjacent to and on an outside of the first surface in the sheet width direction and that is sloped downstream in the sheet conveyance direction toward an outside in the sheet width direction, and wherein a boundary between the first surface and the second surface is positioned outer than the second conveyance member and inner than the first conveyance member in the sheet width direction.

9. The sheet stacking apparatus according to claim 7, further comprising:

a third conveyance member disposed at a position opposite and symmetrical to a position of the first conveyance member with respect to a center of the stacking portion in the sheet width direction, and configured to contact the sheet stacked on the stacking portion and apply conveyance force to the sheet for moving the leading edge of the sheet toward the abutting portion; and a fourth conveyance member disposed at a position opposite and symmetrical to a position of the second conveyance member with respect to the center of the stacking portion in the sheet width direction, and configured to contact the sheet stacked on the stacking portion and apply conveyance force to the sheet for moving the leading edge of the sheet toward the abutting portion, the fourth conveyance member being movable to a position at which the fourth conveyance member contacts the sheet stacked on the stacking portion and to a position to which the fourth conveyance member is retracted from the sheet stacked on the stacking portion.

10. The sheet stacking apparatus according to claim 6, wherein in the sheet width direction, the first conveyance member and the second conveyance member are provided at positions inner than side-edge positions of a sheet of which length in the sheet width direction is shortest among sheets that can be stacked by the sheet stacking apparatus.

11. The sheet stacking apparatus according to claim 6, wherein a contact area of the second conveyance member to the sheet stacked on the stacking portion is shifted downstream in the sheet conveyance direction relative to a contact area of the first conveyance member to the sheet stacked on the stacking portion.

12. The sheet stacking apparatus according to claim 1, wherein the second conveyance member has elasticity and is formed endless, and wherein the sheet stacking apparatus further comprises:

a roller pair configured to nip the second conveyance member, and a driving portion configured to lift and lower the roller pair with respect to the stacking portion to move the second conveyance member between the contact position and the retracted position.

13. The sheet stacking apparatus according to claim 1, wherein the second conveyance member is configured to move to an intermediate position at which the second conveyance member contacts the sheet stacked on the stacking portion, at a contact pressure lower than that at the contact position, and wherein the control portion is configured to execute a third mode in which the second conveyance member is positioned at the intermediate position such that the sheet is conveyed by the first conveyance member and the second conveyance member.

14. The sheet stacking apparatus according to claim 1, wherein the conveyance portion includes:

a belt disposed above the stacking portion and configured to rotate; and a gripper disposed on the belt and configured to nip a sheet.

15. The sheet stacking apparatus according to claim 1, wherein the first conveyance member is configured to contact a top surface of the sheet stacked on the stacking portion and elastically deform, and wherein the second conveyance member at the contact position is configured to contact the top surface of the sheet stacked on the stacking portion and elastically deform.

16. An image forming apparatus comprising:

an image forming apparatus body including an image forming portion configured to form an image on a sheet; and the sheet stacking apparatus according to claim 1, wherein the sheet stacking apparatus is configured to receive a sheet on which an image is formed, from the image forming apparatus body, and stack the sheet.

* * * * *